United States Patent [19]

Martin et al.

[11] 4,075,423

[45] Feb. 21, 1978

[54] SOUND ANALYZING APPARATUS

[75] Inventors: Michael Joseph Martin, Stevenage; Michael John Underwood, Letchworth, both of England

[73] Assignee: International Computers Limited, London, England

[21] Appl. No.: 787,448

[22] Filed: Apr. 14, 1977

[30] Foreign Application Priority Data

Apr. 30, 1976 United Kingdom ..... 17614/76

[51] Int. Cl.[2] ..... G10L 1/00

[52] U.S. Cl. ..... 179/1 SC

[58] Field of Search ..... 179/1 SC, 1 SA, 1 P; 340/146.3 S; 235/92 PC

[56] References Cited

U.S. PATENT DOCUMENTS 3,941,982 3/1976 Knollenberg et al. ..... 235/92 PC

OTHER PUBLICATIONS

M. Schroeder, "Period Histogram etc.," J. of Ac. Soc. Am., vol. 43, No. 4, 1968.

*Primary Examiner*—Kathleen H. Claffy
*Assistant Examiner*—E. S. Kemeny
*Attorney, Agent, or Firm*—Hane, Roberts, Spiecens & Cohen

[57] ABSTRACT

Sound Analyzing Apparatus is described for extracting from a speech signal certain basic formant waveforms present in the signal and then examining the formant waveforms to identify the frequency components of the waveforms, using a histogram format in a digital processor. This frequency analysis is accomplished by rectifying the formant waveform, detecting the occurrence of peaks in the resultant waveform and evaluating the time intervals between successive peaks. The apparatus is also biased to reject as invalid those time intervals when peaks of less than a predetermined magnitude occur. Since the formant waveform is typically a succession of damped waves, the frequencies detected are classified into ranges and a running average of the allocation of the frequency components over the ranges is developed over successive sampling periods in order to provide a histogram output illustrative of the final analysis.

9 Claims, 6 Drawing Figures

SOUND ANALYZING APPARATUS

BACKGROUND OF THE INVENTION

1. Field of the Invention

The present invention relates to sound analysing apparatus and in particular to apparatus for the analysis of speech.

2. Description of the Prior Art

In connection with the analysis of speech sounds for, for example, the recognition of speech by machines such as computers, many attempts have been made to analyse the formulation of speech. While some work has been done on the mechanics of speech production by, for example, analysing the effects of resonance in the cavities of the vocal tract, other work has concentrated upon the analysis of the waveforms of actual speech.

The present invention is concerned with the latter work. It is well established that voiced sound relies upon the presence of certain basic waveforms which have been referred to as formants and attempts have been made to track these formants in speech passages by frequency filtering and mathematical analysis. In such attempts reliance has been placed upon detecting and tracking the energy content of the speech frequency spectrum. The present apparatus proposes a greatly simplified method and apparatus for formant tracking using a two-dimensional averaging process.

SUMMARY OF THE INVENTION

According to the present invention, sound analysing apparatus arranged for the evaluation of speech includes means for extracting from an applied speech signal a required formant waveform; means for identifying frequency components of the required formant in the waveform; a store having a plurality of addressable storage locations each associated respectively with a different predetermined range of frequencies; means for adding during each of a succession of predetermined histogram sampling periods a value of unity for each frequency component identified into that one of the storage locations corresponding to the range in which lies the frequency of the identified component and means for producing over a histogram representation including means for scanning the storage locations in order, to produce for each successive sampling period a running total of the values added into the storage locations during a preceding predetermined number of sampling periods; means for deriving an indication that a predetermined fraction of the total has been equalled or exceeded and means for registering an address representing the frequency range included in the storage location currently being scanned at the time when the indication occurs.

BRIEF DESCRIPTION OF THE DRAWINGS

Apparatus embodying the present invention will now be described, by way of example, with reference to the accompanying drawings, in which.

DESCRIPTION OF THE PREFERRED EMBODIMENTS

In the present arrangement speech to be analysed is fed on to a speech channel, of which there are a number, by means of a sound transducer, typically a carbon microphone as used in speech transmission over telephone communication links.

Figure 1:
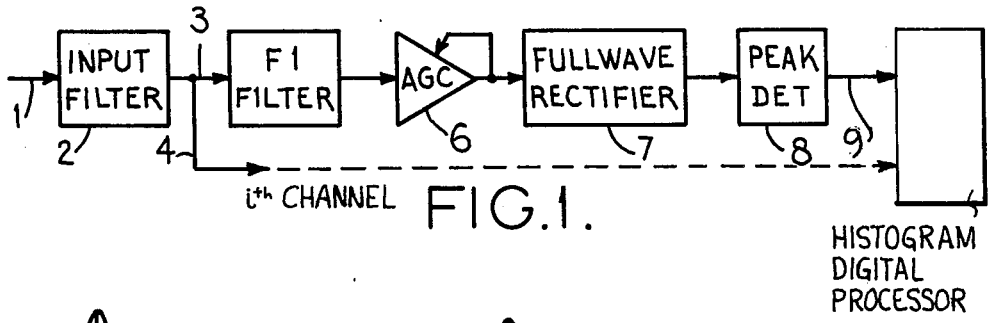
FIG. 1 shows schematically input circuit arrangements for a speech signal.

Referring now to the drawings, FIG. 1 shows a circuit arrangement for producing, from an incoming speech signal, an input for a formant tracking arrangement. The incoming speech signal is applied from a channel 1 to an input filter 2.

The input filter 2 is a band pass filter having a pass bandwidth sufficient to accommodate the range of the formant frequencies to be extracted or tracked.

The resultant signal from the output of the filter 2 is presented over a pair of lines 3 and 4. The line 3 is connected to a further filter 5 having a pass bandwidth corresponding to the frequencies within a range encompassed by a first one of the formants, F1, to be tracked. The line 4 is connected to further filters (not shown) corresponding to the filter 5 for the tracking of other formants. Since the process of tracking of the other formants is the same as for the first formant, only the latter will be described in detail.

From the F1 filter 5, the signal is applied through an automatic gain control circuit 6 to a full wave rectifier 7 and thence to a peak detecting circuit 8, the resultant F1 peak signal then appearing on a line 9. This signal feeds the processor.

Figure 2:
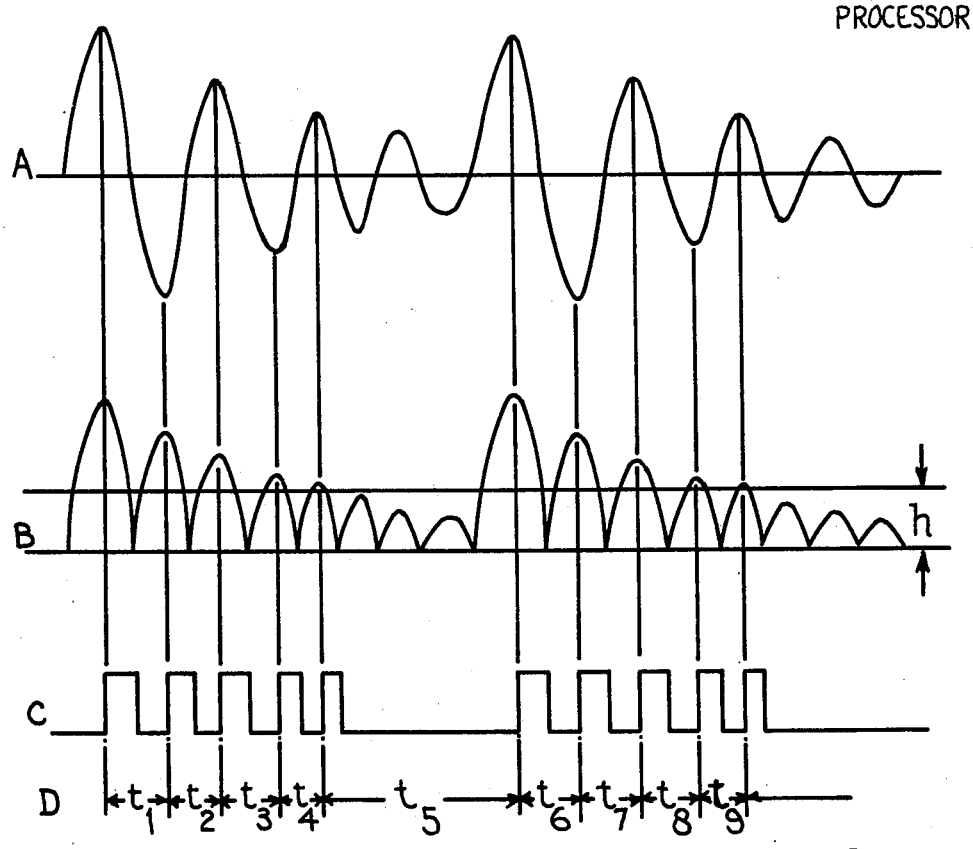
FIG. 2 shows a group of related input waveforms.

The manner in which the circuit of FIG. 1 acts on an input signal to produce the final output on line 9 is illustrated by FIG. 2, in which waveform A represents an incoming speech signal after passing the formant band-width filter 5. The waveform A consists of a succession (of which two are shown) of damped waveforms, each waveform having components of differing frequencies, damped waveforms continuously being generated as the sound continues and changing form as the sound itself changes. Thus, for example a sustained sound would produce a succession of similar damped waveforms, the repetition rate of the waveforms determining the pitch of the sound while the frequencies of the waveform components determine the nature of the sound. Thus, the duration of each complete cycle of the damped waveform corresponds to a pitch period.

After the waveform A has been subjected to automatic gain control and has been rectified by the rectifier 7, its shape has changed to that shown at B, (FIG. 2). A pedestal of height "$h$" is applied to the waveform B which is then applied to the peak detector 8 so that only peaks occurring above the level "$h$" are recognised and a positive-going pulse, as shown in waveform C, is generated for each recognised peak of waveform B, the leading edges of the pulses corresponding to the timing of the peaks. Hence, the relative timings of the leading edges of the pulses provide an indication of the frequencies of the component waves of the waveform A. As shown at D, the time periods $t_1$ to $t_4$ represent half-cycles of the early component waves in the first pitch period, while those periods $t_6$ to $t_9$ represent corresponding waves in the second pitch period. These two groups of time periods are separated by an interval $t_5$ which corresponds to the period when the waveform B is below the recognition pedestal *h*. As will be explained in detail hereafter, the periods $t_1$ to $t_4$ and $t_6$ to $t_9$ are to be evaluated to determine the frequency range into which corresponding waveform components will fall, and the period $t_5$ is to be recognised as an invalid interval for evaluation purposes. By discounting the period $t_5$ in this way it is ensured that all measurements are limited to the high amplitude portion of each pitch period.

Figure 3:
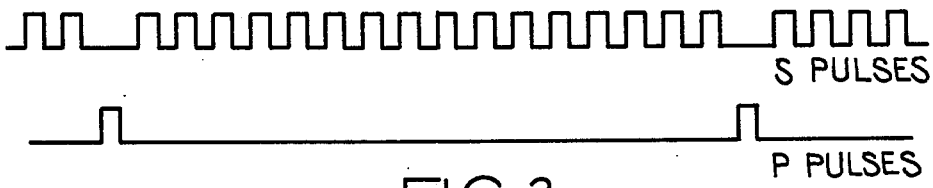
FIG. 3 shows the relationship between timing pulse chains.

Before describing the evaluation of the waveform component frequencies, a basic timing pulse sequence will be first explained with reference to FIG. 3. The tracking apparatus to be described is arranged, as noted earlier, to deal with a plurality of sound-carrying channels and although, for the sake of clarity, the tracking of a single formant on only one channel will be described in detail, the timings of the various operations are dependent upon the interlacing of events in all channels and the pulse trains of FIG. 3 enable the events associated with the various channels to be correctly segregated. It will be assumed throughout the following description that sixteen input channels are provided.

Two pulse trains S and P are provided as shown in the Figure. The train of S pulses is derived from a basic pulse generator (not shown) which produces a continuous stream of pulses spaced at 470nS intervals. The S pulse train consists of successive groups of sixteen of these pulses, the groups being separated by a spacing equivalent to one pulse time. The P pulse train consists of a continuous stream of pulses spaced at intervals equivalent to seventeen of the S pulses and the relative timings of the two pulse trains is such that the P pulses occur during the intervals between successive S pulse groups. It will be seen, therefore, that the P pulses occur at approximately 8uS intervals.

The way in which formant peak information is entered into the apparatus will now be described with reference to FIG. 4. The formant peak signals F1 from the first channel are applied over line 9 (FIGS. 1 and 4) to the first stage 12 of a two-stage shift register an output 12, 13, from the second stage 13 of the shift is applied to the input of an AND gate 14. An output from the first stage 12 12 of the register is also applied to an input of the AND gate 14. The AND gate 14 has its output connected to enter a one-bit into one stage of a 16-stage shift register 15.

Each of the stages of the shift register 15 is connected by means of shift registers and AND gates, as outlined in the preceding paragraph, to the formant signal lines of different channels so that the 16 channels are all coupled to the shift register stages in order. For the sake of simplicity only the formant signal lines 9 and 9' of the first and last channels are shown in the Figure, the line 9' being coupled to the first stage of the register 15 by shift registers 12' and 13' and AND gate 14'.

The shift inputs of all the registers 12, 12' 13 and 13' are connected in common to a line 10 which carries the P pulse train.

The shift input of the shift register 15 is connected to a line 11 which carries the S pulse train groups, the line 11 also being connected to the input of a counter 16. The counter 16 has a radix of 16 and its counter output is applied as an addressing input to a two-value store 17 having sixteen locations each of which is able to store an M and an N value. Upon addressing of the store 17 by the counter output, the M and N values of the addressed location are made available on store outputs 18 and 19 respectively. The store 17 is operated on a conventional read/write cycle basis and the output lines 18 and 19 are connected by way of multiplexers 20 and 21 respectively to a pair of write input lines 22 and 23. The multiplexers 20 and 21 are respectively controlled by a combinational network 24 to provide different values for M and N to be re-entered into the store 17. Such values may be respectively zero or the values from the lines 18 and 19 unchanged or those values increased by unity.

In addition the recirculation path through the multiplexer 20, the M value is applied to an input of a comparator 25. The N value is also applied to address a limit store 26 and the value stored in the addressed location of the store 26 is applied to a second input of the comparator 25. An output signal is available from the comparator 25 when the two inputs are equal and this signal is applied to the combinational network 24 which also receives inputs from the multiplexers 20 and 21 respectively indicating that the M or N values have reached their maximum having regard to the capacities available for their expression. Finally, the output from the shift register 15 is also applied as an input to the network 24 by way of a line 27.

The shift register 15 output on the line 27 is also applied through the network 24, as an enabling signal on a line 30 to a pair of registers 28 and 29, the register 28 being fed with the count output of the counter 16 and the register 29 being fed with the succession of N values from the output line 19 of the store 17.

Figure 4:
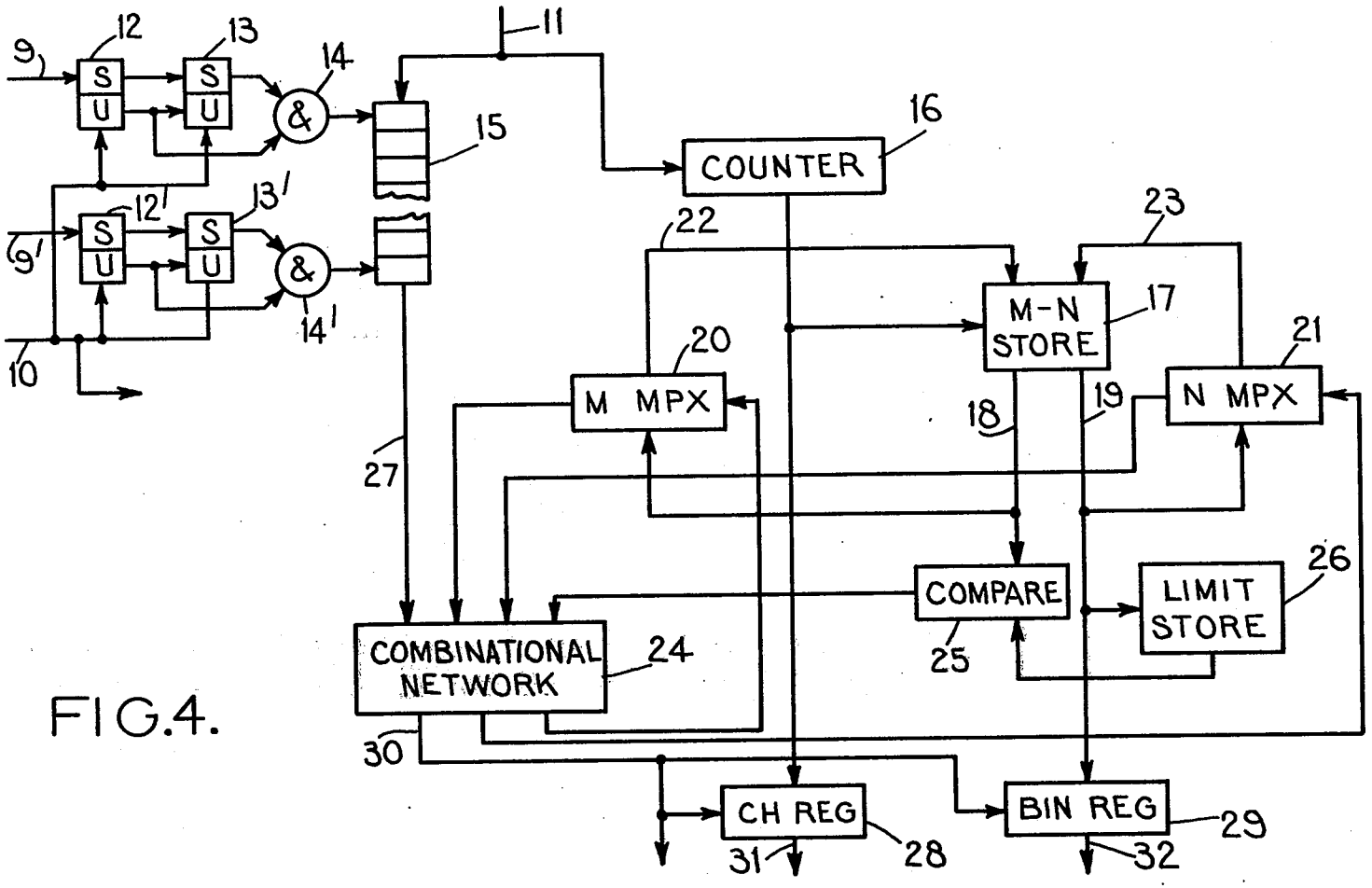
FIG. 4 is a schematic diagram of an input polling circuit.

The co-operation of the elements of FIG. 4 will now be considered in detail. A peak-representing signal occurring on the line 9 is arranged to set the first stage 12 of the shift register 12, 13, and upon the next occurrence of a P pulse on line 10, this set state will be shifted into the second stage 13 of the register, while the first stage is unset. The setting of the second stage 13 of the register produces an output to condition the AND gate 14 which also receives a second signal as the result of unsetting of the first stage 12. Since both inputs of the AND gate 14 are now conditioned an output signal is passed by the gate 14 to enter a one bit into that stage of the register 15 to which the gate 14 is connected.

Upon the occurrence of the following P pulse, the second stage 13 of the shift register is unset to cause the gate 14 to close. Thus, the occurrence of a peak-indicating signal on the input line 9 causes a one bit to be entered into the shift register 15 during the period immediately following the next-occurring P pulse after the peak is detected. The use of the P pulse to control the entry of the peak-representing bit into the shift register 15 ensures that the shift register 15 is loaded with peak-representing bits in the interval between successive groups of S pulses. It will be seen that there are as many stages in the register 15 as there are channels and that each channel has its own stage associated with it. It will be understood that although peak-representing signals from the channel lines 9, 9' may occur at any time, two such signals cannot occur in a single channel during one inter P-pulse period.

Thus, at the beginning of each S-pulse group, the shift register 15 contains a pattern of bits in its stages in which one-bits correspond to those channels in which a peak has been detected during the preceding 8uS period. The application of the S pulses to the shift register 15 causes the contents of the register to be shifted serially to the output of the register 15 and because the number of S pulses in a group is equal to the number of stages in the register 15, then the serial output from the register 15 on line 27 will be a pattern in which the bits are in order corresponding to channel address. The concurrent application of the same group of S pulses to the counter 16 ensures that an actual channel address is produced at the output of the counter 16 in time synchronism with the occurrence of the bit in the pattern on line 27 corresponding to that same channel. It will be seen, therefore, that the store addresses produced by the counter 16 actually correspond to the addresses of the channels connected to the shift register 15, and it follows that the store 17 has a separate location for each channel from which the current M and N values for that channel are retrieved. The application of a single S-pulse group to scan out the contents of the register 15 and to address the counter 16 will be referred to as a polling operation.

In order to explain the significance of the M and N values it is first necessary to consider the way in which the time intervals between the detection of successive peaks in a single channel may be evaluated to indicate the frequency of the sound waveform component represented. Taking the case of a waveform having a frequency of 1 KHz, for example, the time interval between two peaks of like polarity will be 1.00mS. Because, in the present case, the input waveform has been subjected to full wave rectification, a waveform of this frequency will actually produce peaks at intervals of 0.5mS. This time interval corresponds to the passage of 63 successive periods of 8uS. By similar reasoning Table 1 may be constructed to show, in the first three columns, the relationship between a range of frequencies, elapsed time intervals between peaks and the equivalent intervals expressed in terms of 8uS periods.

TABLE 1

| Frequency | Elapsed time since last peak | Equivalent number of 8uS periods | Current difference | Range (N) |
|---|---|---|---|---|
| 1Khz | 0.500mS | 63 | 63 | 0 |
| 900 Hz | 0.555mS | 70 | 7 | 1 |
| 800 Hz | 0.625mS | 79 | 9 | 2 |
| 700 Hz | 0.715mS | 90 | 11 | 3 |
| 600 Hz | 0.835mS | 105 | 15 | 4 |
| 500 Hz | 1.000mS | 125 | 20 | 5 |
| 400 Hz | 1.250mS | 157 | 32 | 6 |
| 300 Hz | 1.666mS | 209 | 52 | 7 |
| 200 Hz | 2.500ms | 313 | 104 | 8 |
| 100 Hz | 5.000mS | 625 | 312 | 9 |

The fourth column of the table shows the difference between the present and preceding values of column 3 while the last column provides an indication of the frequency range for each line of the table in arbitrary terms and is also used as the N value, as will be explained, to provide an address both for the store 26 and as an output from the register 29.

To illustrate the operation of the M-N values let it be assumed that a peak has been detected in a particular channel. In this case a one bit will occur during the current polling operation in the output from the shift register 15 over line 27 and will be applied to the combinational network 24 as the address of the channel concerned is produced by the counter 16. The application of this address to the store 17 causes the current M and N values for the channel under consideration to be made available on lines 18 and 19 to the multiplexers 20 and 21. In response to the one bit from line 27 the combinational network 24 produces control outputs to cause the multiplexers 20 and 21 to select the value zero to be applied to the inputs 22 and 23 of the store 17. Thus, the M and N values for the channel under consideration are both reset to zero in readiness for a new peak frequency evaluation process.

It is assumed that no peak is detected before the next polling operation and no one-bit occurs on line 27 when the channel address is produced by the counter 16. Application of the address to the store 17 causes the value zero to be read out to both M and N multiplexers 20 and 21. Under these conditions the combinational network 24 conditions the multiplexer 21 to add unity to the M value before it is rewritten into the store 17, the value of M thus being changed to 1. However, the current M value (0) is applied to one input of the comparator 25.

The N value is applied to address the limit store 26. For the sake of the present example it is assumed that the store 26 contains a series of values corresponding to the values in the "Current difference" column of Table 1, each value being stored at an address corresponding to the "Range" column of the same Table. Thus, at address 0 (the address represented by the current N value) the current difference is 63 and this is the limit value read out from the store 26 to the second input of the comparator 25. Since the value of M and the limit value are different, no output is produced from the comparator 25 during the polling operation, with the result that, under these conditions the N multiplexer 21 is conditioned to return the value N unchanged to the store 17.

It will be realised that if no peak is detected during the next 61 polling operations the value of N (i.e. 0) will continue to circulate unchanged while the value of M will progressively be increased until at the end of the 62 polling operation since the last occurrence of a peak in the channel under consideration the value of M rewritten into the store 17 is 63.

If, on the next polling operation, a peak is still not detected in this channel, the situation is that the M value (63) applied to the comparator 25 is equal to the first limit value (63) read from the limit store 26. In this case an output is produced by the comparator 25 and applied to the combinational network 24 to modify the control signals applied to the multiplexers 20 and 21 so that the recirculated M value is once again zero while unity is added to the N value. Thus, in readiness for the next polling operation, M = 0 and N = 1, and the next polling operation will be the sixty-fourth since a peak was last recognised. It will thus be apparent that the frequency of the waveform component currently being evaluated cannot lie in the range above 1KHz. It will also be seen that the value of N indicates the frequency range in which a component lies since the value of N is increased to select a new limit value from the limit store 26 each time the M value reaches the current limit value which corresponds to the end of a particular frequency range.

Thus, provided that no peak is detected during the next seven polling operations the N value will be 1 and the M value will progressively increase from 0–7. During this time the N value addresses location 1 to produce the limit value 7 and when the M value reaches this limit value, the N value is advanced by unity while the M value is zeroised. From inspection of the Table it will be seen that N = 0 indicates a frequency above 1KHz; N = 1 indicates a frequency in the range 1KHz to 900Hz; N = 2 indicates a frequency in the range 900Hz to 800Hz, and so on. It will also be appreciated that the N value also selects the limiting value for M applicable to the current frequency range, the M value being increased by unity for each 8uS period (which corresponds to the time for each polling operation). Thus, until a peak is detected the M value is reset for each new range whenever it reaches the current limiting value and at the same time the N value is increased to select a new limiting value appropriate to the new range.

Let it now be assumed that a peak has been detected and a one bit occurs on the line 27 when the appropriate channel address is produced by the counter 16. The application of this bit to the combinational network 24 causes the outputs from the network 24 to condition both multiplexers 20 and 21 to reset the M and N values to zero upon being re-written into the store 17. At the same time, the occurrence of the one bit on line 27 produces a corresponding signal on line 30 to enable the registers 28 and 29 to register, respectively, the current channel address from the counter 16 and the current N value. As will be explained, the channel address and the N value, which will be referred to as the bin address, are to be used in conjunction with a histogram store to develop a summation of the formant characteristics throughout a chosen sampling period. The signal on line 30 is derived from the line 27 unless the time interval being dealt with is to be regarded as invalid, as will now be explained before concluding the detailed description of the present arrangement.

It will be recalled that the combinational circuit is fed with signals from the multiplexers 20 and 21 which indicate that the M and N values respectively have reached their maximum permissible values. These signals are generated by gating arrays within the multiplexers which detect the presence of one bits in all denominations of the M and N value expressions respectively. Consideration of these maxima shows that if the N value reaches its maximum, it has passed outside the permissible ranges of frequency as expressed, for example, in Table 1 as appropriate for the formant concerned. Equally, if the M value reaches its maximum, then so many 8uS periods have elapsed since last it was reset that the time since a peak was last registered exceeds any period that has any meaning in the context of tracking of the formant concerned. As an example, the time concerned might well be the period $t_5$ shown in FIG. 2 which is to be recognised as an invalid interval. Under these circumstances the application of M and N maximum signals to the combinational network 24 cause the output control signals from the network 24 to the multiplexers 20 and 21 to preserve the M and N values. Thus, since the N value will reach its maximum before the M value, the presence of an "N = maximum" signal will cause the N multiplexer 21 to pass on the N value unchanged for re-entry into the store 17 while the M multiplexer 20 continues to pass on the value M + 1. This action continues until the "M = maximum" signal is produced, when the M multiplexer is caused to pass on the M value unchanged. The values for M and N are reset to zero on the occurrence of the next peak in the channel and the process of evaluation of the time period of the waveform components is resumed.

In practice, the M and/or N maximum signals are preferably used positively to inhibit the registration of values in the registers 28 and 29 altogether, by, for example, controlling a gate in the line 27 to prevent the one-bit on this line from being passed as an output signal to line 30. Alternatively, for example, the M value maximum signal alone could be used to identify the invalidity of the timing period, in which case all the possible values for N could be used as legitimate addresses.

It will also be realised that the number and distribution of the frequency ranges as set out in Table 1 are exemplary only and each formant to be tracked would have a sequence of limit values in its associated limit store 26 which are chosen to provide and identify the required frequency division and ranges in each case.

The operations to be performed by the combinational network 24 may be summarised as follows:

If a peak signal occurs on line 27, then the multiplexers 20 and 21 are conditioned to pass the values M = 0 and N = 0 to the write input of the store 17. (The address values will also be registered in the registers 28 and 29 by the extension of the peak signal to line 30, unless registration is inhibited by the M and/or N maximum value signals)

If a peak signal does not occur, then the output of the comparator is checked:

If the output indicates that M has reached a limit value: then the multiplexer 20 passes the value M = 0, and if N has not reached its maximum, multiplexer 21 passes the value N + 1. If N is already at its maximum value, the multiplexer 21 passes this value unchanged.

If the output does not indicate that M has reached a limit value: then multiplexer 21 passes the current value of N unchanged and if M has not reached its maximum, multiplexer 20 passes the value M + 1. If M is already at its maximum value, the multiplexer 20 passes this value unchanged.

The logical gating arrangements provided in the network 24 are coupled in conventional manner to achieve these output conditions.

Outputs from the registers 28 and 29 are to be entered into a store in the form of a histogram. The arrangements for the storage and processing of the histogram components will now be described with reference to FIG. 5. A histogram store 33 is divided into a number of sections 34, each arranged to deal with a separate formant. The particular section of 34 allocated to the formant at present under consideration is shown as a vertical strip in the Figure and is divided into four segments 35 of which the uppermost is shown in greater detail. Each segment 35 contains separate storage areas 36 for each of sixteen channels and each channel storage area 36 has sixteen storage locations 37 which will be referred to as storage bins.

Thus a full address to specify a particular bin will require the specification of segment, channel and bin addresses for a given formant section of the store. Because all the formants are independently treated, each section of the store is wired to its own addressing registers and the formant component of the store address may therefore be disregarded for the purposes of the present explanation. The remaining address components are applied to an address decoder 38 which decodes applied components to select a required bin in the conventional manner, the store 33 being operated on a read/write selection basis in known manner to make available the contents of an addressed bin on an output line 39.

For re-writing into the addressed bin, a recirculating loop to an input or writing control multiplexer 41 includes an adder 40 having a second input energised to represent unity by an inverter 42, fed by P-pulses from the line 10. Thus, a value appearing on the output line 39 in the absence of a P-pulse is increased by unity before being re-written into the same bin from which it was read. For resetting purposes, provision is made within the multiplexer 41 for inhibiting rewriting of the circulated value in response to a signal on an inhibit line 47, and writing zeros instead.

The address components are applied to the selector 38 by a group of multiplexers. A multiplexer 43 provides the segment address component, a multiplexer 44 provides the channel address component and a multiplexer 45 provides the bin address component. Multiplexers 44 and 45 are supplied with addresses from a counter 46 and from output lines 31 and 32 of registers 28 and 29 (FIG. 4) respectively while the control line 30 from these registers is also applied to the multiplexers 44 and 45 (FIG. 5) so that a single address group is rendered effective each time a peak signal occurs on the line 30.

The multiplexer 43 receives addressing inputs from a four-state counter 48 and a count control multiplexer 50. A control input from the P-pulse line 10 enables only one of these inputs at a time, as will be explained. The multiplexer 50 receives inputs from the four-state counter 48 and from a three-state counter 49. The four-state counter is fed by pulses derived from setting of a bistable 51, while the three-state counter 49 is fed by P-pulses from the line 10. In addition to the count outputs applied to the multiplexer 50, the counter 49 provides a train of timing pulses at one-third the frequency of the P-pulses to an AND gate 61 which is conditioned by the set output of the bistable 51 and synchronised by the direct application of P-pulses from line 10. The timing pulses are applied to the counter 46.

The output line 39 of the histogram store 33 is also connected, as well as to the adder 40, as one input to an adder 53 whose output is connected to a pair of accumulators 54 and 55. The accumulator 54 receives the output of the adder 53 unchanged and in turn provides a second input for the adder 53, so that the accumulator 54 holds the rolling total of values appearing on the store output line 39 for as long as it has not been reset to zero. An OR gate 63 provides a resetting control signal for the accumulator 54 and, in turn, receives an input derived from the fifth stage of the counter 46, another from an inverter 67 which is also connected to the same stage of the counter 46 and a third from the bistable 51.

The signal from the bistable 51 also applied through an OR gate 68 to reset the accumulator 55. The OR gate 68 also receives the signal from the inverter 67 to reset the accumulator 55. The accumulator 55 receives the output from the adder 53 shifted by one binary position to the right so that the value registered by the accumulator 55 is half that of the adder output. Outputs from the accumulators 54 and 55 are applied to two inputs of a comparator 57, which as will be explained, produces an output if the value in the accumulator 54 equals or exceeds that in accumulator 55 (which must exceed zero). The output of the comparator 57 is applied to an AND gate 58 which is conditioned by the output from the fifth stage of the counter 46, which also provides an inhibiting input for the accumulator 55 to prevent the total registered therein from being modified. This operation is accomplished in conventional manner by the closure of an input gate (not shown).

The AND gate 58 produces an output which is applied to condition a pair of registers 59 and 60, respectively connected to receive the channel address and bin address values applied to the multiplexers 44 and 45 by the counter 46.

Finally, the inhibit line 47 receives its signal from an AND gate 69 which is conditioned by signals from the fifth stage of the counter 46, by a selection line from multiplexer 50 to be described and by P-pulses from the line 10.

Figure 5:
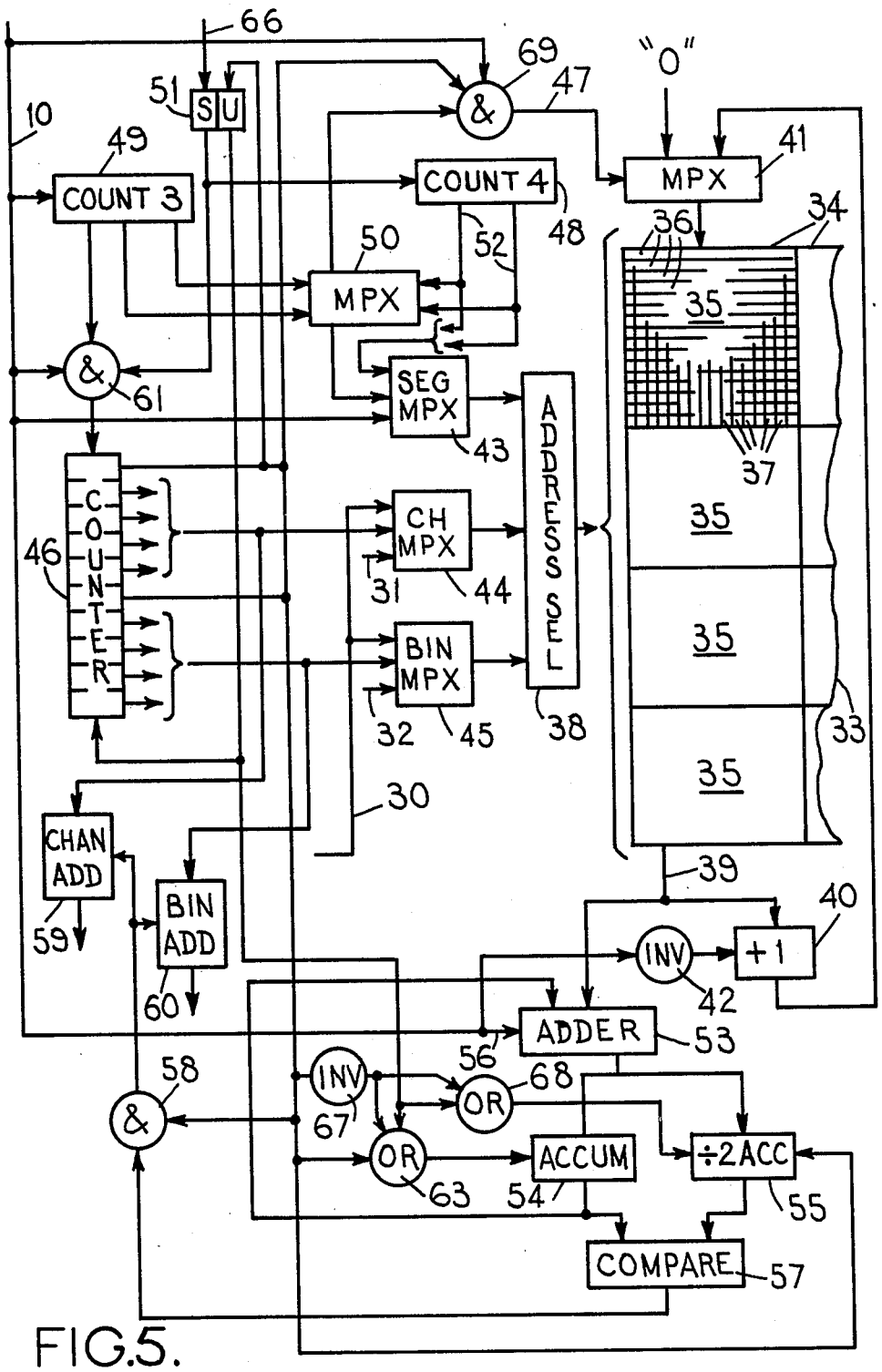
FIG. 5 is a schematic diagram showing store control and addressing arrangements.

Before considering in detail the operation of the circuit of FIG. 5, the addressing arrangements of the histogram store 33 will be reviewed. For any one channel area 36 of the store 33, the storage bins 37 are each associated with a specific frequency range and the frequency ranges for the bins of a channel are chosen to correspond to those specified for a polling operation by the limit store 26 (FIG. 4), the higher frequency ranges being associated with lower valued bin addresses. Thus the outputs from the register 28 and 29 represent channel and bin addresses for a predetermined formant section of the store 33. However, before a polling operation can be completed by writing away in the store 33 information relating to the occurrence of a peak it is necessary to produce a segment address. The way in which segment addresses are derived will now be considered in detail.

It will be recalled that P-pulses on the line 10 occur at approximately 8uS intervals and that a complete sequence of channel addresses, produced by the counter 16 (FIG. 4) in response to an S-pulse group, occurs in the interval between successive P-pulses. The P-pulses are applied to the 3-state counter 49 (FIG. 5) which produces a pair of output signals referred to as A/B and which cyclically assume the respective binary values 0/0; 0/1 and 1/0. At the same time the output derived from the counter 49 which is applied to the AND gate 61, consists of a pulse train at one-third the frequency of the P-pulse input. This output will be referred to as a train of C-pulses, and is used to drive the counter 46.

A histogram sampling period is predetermined and typically may be of the order of some 20mS. A series of timing pulses at this frequency are generated, for example by frequency division from the master timing pulse generator, and are applied to a line 66 to set the bistable 51. The set output of the bistable 51 is used to open the gate 61 and also to apply a counting pulse to the 4-state counter 48. The counter 48 produces a pair of outputs referred to as C/D which cyclically assume the binary values 0/0; 1/0; 1/1 and 0/1. The C/D values are applied directly to the segment address multiplexer 43 and also the multiplexer 50, whose output is also applied to the multiplexer 43. The P-pulses are also applied to the multiplexer 43 to regulate which of the inputs are permitted to pass to the address selector 38 as the segment address. Thus, in the absence of a P-pulse, the C/D values from the counter 48 form the segment address but, for the duration of each P-pulse, the segment address is changed to correspond to that produced by the multiplexer 50.

The manner in which the A/B and C/D values cooperate to produce an output segment address may be illustrated by means of Table 2:

TABLE 2

| | | Segment Adresses | |
|---|---|---|---|
| A/B values | C/D values | Polling operation | Histogram evaluation |
| 00 | 00 | 00 | 11 |
| 01 | 00 | 00 | 10 |
| 10 | 00 | 00 | 01 |
| 00 | 10 | 10 | 01 |
| 01 | 10 | 10 | 00 |
| 10 | 10 | 10 | 11 |
| 00 | 11 | 11 | 00 |

TABLE 2-continued

| A/B values | C/D values | Segment Adresses: Polling operation | Segment Adresses: Histogram evaluation |
|---|---|---|---|
| 01 | 11 | 11 | 01 |
| 10 | 11 | 11 | 10 |
| 00 | 01 | 01 | 10 |
| 01 | 01 | 01 | 11 |
| 10 | 01 | 01 | 00 |

From Table 2 it will be seen that the multiplexer 50 is conditioned by the C/D values to produce an output by acting on the A/B values as follows: the C value controls the passage of the A value through the multiplexer 50, while the D value controls that of the B value, the modification being that if the C or D value is zero, the respective controlled value is inverted, whereas if the controlling value is one, the controlled value is unchanged. Thus, if C/D is 0/0 then the A/B values are both inverted; if C/D is 1/0 then only the B value of the A/B expression is inverted; if C/D is 0/1, only the A value is inverted and if C/D is 1/1 neither value is changed. It will also be seen that in each complete cycle of the A/B values, the multiplexer 50 outputs are always different from the C/D values. Thus, in a polling operation, as eariler described, channel and bin addresses are produced in response to sensing of a peak, and the timing of the polling operation is such that these addresses are produced during the passage of an S-pulse group, which always occurs in the absence of a P-pulse. Thus the polling operation can only produce a store addressing requirement when a P-pulse is not present and the segment address for polling operations will be seen from the third column of Table 2 to correspond to the directly-applied C/D values. It will also be appreciated from FIG. 5 that the multiplexers 44 and 45, which are conditioned to permit the polling operation addresses from the registers 28 and 29 if the signal on line 30 is present will also select the channel and bin addresses for the polling operation at a time when a P-pulse is absent, so that during polling, the detection of a peak causes the contents of that bin corresponding to the frequency range represented by the detected peak in the channel concerned to be read out from the segment whose address is specified by the C/D values. Moreover, although the C/D values for polling will remain unchanged for a complete histogram sampling period of some 20mS, nevertheless the A/B values will change every 8uS with the P-pulse and the selection of the polling segment will be interrupted for the duration of a P-pulse every 8uS and the remaining segments will be addressed in cyclic sequence for a histogram evaluation operation.

Before describing a histogram evaluation operation, however, the completion of a polling operation will be briefly reviewed. The contents of the addressed bin 37 are read out from the store 33 to the output line 39. Because no P-pulse is present, adder 53 is not enabled. Adder 40 is enabled by a signal from inverter 42 and the value read out is increased by unity and returned to the addressed bin 37 through multiplexer 41. During the sampling period for which the same segment 35 remains constantly selected for polling, the peaks detected in any of the channels are evaluated for frequency by the M-value comparisons and are stored as entries of unity into corresponding bins 37 of the store 33 and where, in the course of the sampling period, a number of peaks correspond to the same bin 37, the value contained in that bin is increased by unity for each peak detected. Thus, at the end of a sampling period, each of the bins 37 of the polling segment 35 concerned contains a value representative respectively of the number of times a peak has been detected in the associated channel 36 within the frequency range represented by that bin. Also, at the end of the histogram sampling period, the segment 35 into which the polling entries are to be made is changed so that peak occurrences are accumulated into the new segment 35 (represented by the new C/D address) while the entries in the previously used segment 35 are available for a histogram evaluation operation.

The operation of histogram evaluation requires that the occurrences of peaks in the preceding three sampling periods shall be correlated and averaged and thus requires the selection in a predetermined relationship to each other, of the bins 37 in all the segments 35 not currently being used for polling. Consideration of Table 2 shows that the A/B value, after modification, produce the addresses of the required segments 35 and, because the A/B values are cycled over three consecutive P-pulses, then these segments 5 are selected in cyclic rotation, a different one for each 3P-pulse. It will also be recalled that the C-pulses from AND gate 61 to step the counter 46 occur at one-third the frequency of the P-pulses. Before considering the interaction of these two sets of pulses, the way in which channel and bin addresses are generated by the counter 46 will first be considered.

The counter 46 is a straightforward binary counter whose total count is indicated by outputs from its stages. Those four stages of least denominational significance are connected to the multiplexer 45. Thus, assuming that the counter 46 is initially set to a count of zero, the first 16 count outputs produced as the count is advanced will correspond to selection of all the bins 37 of a single channel 36. During this period the fifth stage of the counter 46 registers zero. On the seventeeth step of the counter 46 the output of the fifth stage changes to register a one and the outputs of the preceding four stages then recycle as before, as the count is advanced, once more selecting all 16 bins 37 in sequence. After this second cycle has been completed, the fifth stage output is reset to zero and the sixth stage output is changed to a one, the whole process then being repeated. The outputs of the sixth to ninth stages inclusive are connected to the channel address multiplexer 44 to form channel addresses in sequential order as the count proceeds. Thus, it will be seen that the channel addresses are applied to the multiplexer 44 to select the channels 36 in sequence. While each channel 36 is selected, its bins 37 are cycled twice; once with the fifth stage output at zero and a second time while the fifth stage output is at one. When the bins of all the channels have been cycled twice in this way, the count produces a one at the tenth stage output, and this output is used to terminate counting by being applied to unset the bistable 51, a pulse being derived from the unset output of the bistable 51, as it switches, to reset the counter 46 to zero.

The way in which the selection of the bins 37 is used for histogram evaluation will now be reviewed. It will be assumed that during the current sampling period, the polling segment 35 is the segment whose address is 00 and that the counters 46, 48 and 49 are reset to zero at the commencement of the period. For simplicity in the ensuing description the segments 35 will be referred to by their addresses. Throughout this period, during the intervals between P-pulses, the polling operation takes place, the peak occurrences being registered and stored in the segment 00 as previously described. The first P-pulse to occur during the sampling period causes the channel and bin addresses (which are "zero" in each case) to be applied through the multiplexers 44 and 45 respectively to the store 33. The counter 49 produces the output 00 (as indicated in Table 2) at this time, so that the segment address from the multiplexer 43 selects the segment 11. Thus, the contents of the first bin 37 in the first channel 36 of segment 11 appear on output line 39 of the store 33.

Because of P-pulse is present, no "add unity" signal is applied to the adder 40, and the contents of the bin are returned unchanged to the store 33. The adder 53 is enabled to register the value represented by the output and this value is passed to the accumulators 54, and 55. From the accumulator 54 the value is re-applied to the adder 53 in readiness for the next entry into the adder 53 from the line 39. In the absence of the control signal from the fifth stage of the counter 46, the accumulator 55 registers half the value read-out at this time (or zero if no value is stored in the bin).

The second P-pulse of the period causes the output of counter 49 to advance by unity and the segment address is changed by the multiplexer 50 to select segment 10. The counter 46 does not change, however, so that the first bin 37 of the first channel 36 of this new segment is read out to the output line 39. From the line 39 this new value is re-written unchanged into the bin 37 from which it came and is also applied to the adder 53 where it is added to the value ready in the accumulator 54, the new total being fed to the accumulator 54 in which it replaces the existing total in readiness for the next adding operation. The accumulator 55 also registers half this new total.

On the third P-pulse, again only the segment address is changed, this time to select segment 01 and the contents of the first bin 37 of the first channel 36 in this segment are added to the total already in the accumulator 54, as well as being preserved unchanged in the bin. On this occasion, however, the counter 43 also produces a C-pulse output to AND gate 61 which is passed to counter 46 to increase its count output by unity in readiness for the occurrence of the fourth P-pulse.

On the fourth P-pulse, the bin address has therefore been changed to select the second bin 37 but the channel address still selects the first channel 36. The output of multiplexer 50 in response to the incrementing of the A/B values by counter 49 reselects the segment 11. Hence, the contents of the second bin 37 of the first channel 36 of segment 11 are added to the value in the accumulator 54 while being preserved unchanged in the bin itself.

The fifth and sixth P-pulses cause the contents of the second bin 37 of the first channel 36 in the segments 10 and 01 respectively to be added to the accumulator 54 total, while the sixth value also steps the counter 46 to select the third bin 37 on the next three P-pulses, the channel address remaining unchanged.

In this way it will be seen that in response to the continued occurrence of P-pulses, all the bins of the first channel 36 in segments 11, 10 and 01 are read out in turn so that their contents are accumulated into the accumulator 54 as the count output of counter 46 is advanced from 0 to 15.

At the end of this period the fifth stage output from counter 46 is switched to one and the bin address count output is reset to zero in readiness for a new cycle of bin selection. The occurrence of this output from counter 46 prevents the value in the accumulator 55 from being changed during the next selection cycle of the bin addresses but causes the accumulator 54 to be reset.

To recapitulate, the complete bin selection cycle so far described has selected all the bins 37 of the first channel 36 in all three segments 35 of the histogram store other than that currently in use for a polling operation, and a value representing half the total number of peaks (of whatever frequency) detected in those segments for this single channel is registered in the accumulator 55. The bin address selection arrangement has, at this point, been reset in readiness for another selection cycle. Two other points are to be observed: Firstly, the bin addresses are so allocated to the bins by the N-values previously described that the bin cycling sequence always starts with the bins in each segment concerned with peaks of highest frequency, and secondly, since the segments are selected for polling operations in order, as determined by the C/D outputs of the counter 48, it follows that (except at the beginning of a new formant tracking operation) the three segments sampled during the histogram evaluation must always have received their peak-representing values during the three sampling periods immediately preceding that currently in progress.

The evaluation now proceeds with the selection of the same bins once more from the same three segments and in the same order as before. During this process the progressive total of the values read out will be accumulated in the accumulator 54 as before, The accumulator 55 meanwhile continuing to hold the half-value registered at the end of the first bin selection cycle. Hence, at some point during the second bin selection cycle, the value of the total in the accumulator 54 will equal or exceed the value in the accumulator 55 and at this point the comparator 57, to which these values are applied, produces an output. This output is passed by the gate 58, conditioned on this selection cycle by the output from the fifth stage of counter 46, to enable registers 59 and 60 to register the channel and bin addresses reached by the selection cycle at the time when the comparator 57 output is produced. The values registered by the registers 59 and 60 constitute the output of the formant tracking arrangement and their form will be illustrated in greater detail hereafter.

Once the address values have been entered into the registers 59 and 60, the store 33 output accumulators 54 and 55 may be reset in readiness for the next channel cycle and resetting may therefore be controlled by the output from the comparator 57 applied through suitable delays, for example. Preferably, A and to ensure that resetting takes place if a comparator 57 fails to produce an output, resetting may be made dependent, as shown in FIG. 5, upon the output of counter 46 so that it always takes place before a new channel cycle begins. Thus, accumulators 54 and 55 are both reset by a pulse signal derived from inverter 67 as the output from the fifth stage of counter 46 resets from one to zero at the end of the second bin selection cycle for each channel. The inverted signal is applied through OR gate 63 to reset the accumulator 54 and through OR gate 55 to reset accumulator 55.

The double cycling of all the bins 37 of each channel 36 in turn continues until all the channels 36 have been dealt with, and in each case the first cycle is used to produce in the accumulator 55 a value representing half the total number of peaks registered, while the second cycle produces an output to register the bin 37 and channel 36 addresses at the point when the progressive total exceeds the half-total value. It will be realised that the double cycling of bins 37 in all channels 36 will occupy less time than the sampling period of 20mS, and it is required to terminate the bin cycling operation when all channels 36 have been dealt with. Thus, the occurrence of an output from the tenth stage of counter 46 indicates completion of cycling, and is used to terminate the operation by resetting the bistable 51. The counter 46 is reset by a general resetting output pulse derived on resetting of this bistable. Thus, this same output pulse is also used to reset the accumulators 54 and 55 through the reset OR-gates 63 and 68.

It will be realised that the values stored in the segments 35 of the store 33 require selective resetting to zero. Thus, immediately prior to each sampling period the segment 35 which is not to be used for the polling operations requires its bins to be reset. The remaining three segments 35, however must have their existing bin values preserved. The control line 47 for the multiplexer 47 is used to cause the writing of zero values into the bins 37 of the next segment 35 to be used for polling. For this purpose the line 47 carries a signal passed by the AND gate 69 which is opened only on coincidence of its input signals as follows: A control line from the multiplexer 50 carries an enabling signal during the selection of the address of the next segment to be used for polling. Thus, using the values from Table 2, if the C/D value is 00, then the signal is produced whenever the segment address applied to the multiplexer 43 is 10; if the C/D value is 10, the signal is produced for the address 11, and so on, these conditions being determined by conventional logic gating. In addition to the signal from the multiplexer 50, the AND gate 69 is also conditioned by P-pulses from line 10 so that zero writing occurs only on evaluation operations, and also by the output from the fifth stage of counter 46 so that this zero entry is further limited to the second bin address cycle for each channel.

Figure 6:
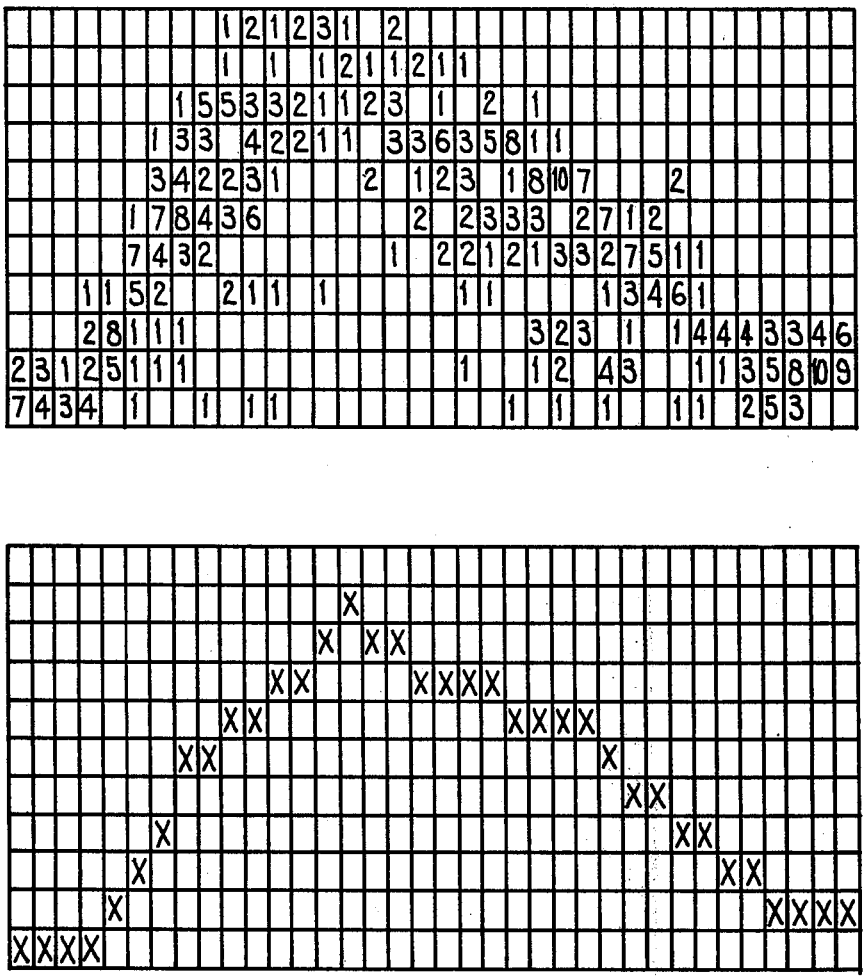
FIG. 6 is an explanatory diagram illustrating the derivation of an output formant track.

In order to show how a histogram output is developed for a single channel, FIG. 6 illustrates the derivation of an output from a succession of stored bin values. In the upper part of the Figure, rows of boxes correspond to the bins of a channel, the topmost row corresponding to the highest frequency range, and hence to the bin having the lowest address value, while the lowest row represents the bins concerned with the lowest frequency range, which bins also have the highest address value. For the purposes of the present explanation, only eleven bins are shown in each vertical column, although it will be understood from the preceding description that sixteen bins would normally be provided. The vertical columns each represent the same channel in successive sampling periods from which it follows that successive columns represent the contents of the bins of that channel in the different segments selected in cyclic order such that every fourth column represents the bins of the same segment with the values that they would contain after different sampling periods. To illustrate the evaulation operation throughout the two bin addressing cycles, it will be recalled that each cycle addresses three segments preceding that currently in use for polling. Thus, if, say, the fourth columns of both parts of the Figure are considered, a first bin addressing cycle addresses the second, third and fourth bin columns of the upper part of the Figure and accumulates the values in the boxes of these columns, starting from the top row and proceeding across the boxes of these columns as each row is selected in turn. The values read out during this cycle will be seen to be: 1, 2, 3, 1, 2, 4, 3, 4. The total accumulated by accumulator 54 (FIG. 5) during this cycle will therefore be 20, while the accumulator 55 registers the value 10. During the second cycle an output from the comparator 57 occurs after the values 1, 2, 3, 1, 2, 4 have been read out, the accumulator 54 then registering 13, thus exceeding the value registered by the accumulator 55 for the first time in this addressing cycle. Inspection of the upper part of FIG. 5 shows that the final value, 4, is read out while the lowermost row of boxes is interrogated and an X is entered into the lowest box of column 4 of the lower part of the Figure to signify the production of the comparator output at this position. A similar process of evaluation carried out for all the columns of the lower part of the Figure produces the pattern shown, the occurrence of an X in the column indicating the row (or bin addressed) at which a comparator output is obtained.

It will be realised that the outputs registered by the registers 59 and 60 may be used in various ways. For example a recorder or graph plotter may be associated with a channel or channels and the channel address register 59 then provides the means by which the output may be correctly associated with the recorder. The bin address from the register 60 then provides an indication of value to enable graphical plot similar to the lower part of FIG. 6 to be made. This approach is useful if only the graphical analysis of the formants is required. However, where the output is required, for example, for subsequent synthesis of sound or speech, if may be preferred to provide the output information in digital form and in this case the data registered in the registers 59 and 60 may then, for example, be entered into storage associated with the synthesising apparatus.

The apparatus has been described as having sixteen channels and sixteen bins in each channel. It will be realised that the number of channels may be varied as may be required, the number being limited by the speed of response of the sampling arrangements and the frequency of sampling required for plotting purposes, for example. The number of bins may also be varied in dependence, for example, upon the required definition of the formant analysis.

The foregoing description deals with tracking a single formant and it will be realised that more than one formant may be dealt with, the processing of information relating to the different formants taking place concurrently. EIn this case it will be seen that segment and channel addressing may be common to all formants while the bin derivation is preferably individual to each formant, at least for polling. Equally, the number of segments of storage may differ from the four described. However, while it is desired to form a running average over three segments, then a minimum of four must be provided to permit polling and evaluation operations to be interlaced as described. Thus, it will readily be appreciated that where averaging is required over n segments, then n+1 will be required for such interlaced operation.

It will be realised that the process described is arranged to extract the weighted means frequency range of components of the waveform through successive sampling periods, and that the provision of a half-total accumulator enables the median point in the distribution of the recognised frequency components to be accomplished simply by the relative shifting of a binary-coded value. It will also be understood that a similarly weighted average point may be extracted by, for example, dividing the sum of the three segment values by three. This, in practice, does not seriously effect general shape of the histogram output obtained and, in practice the fraction of the total to be used for the determination of the histogram drawing values may be varied.

As described, a period of 20mS has been used as the basic sampling period. It has been found that this period permits the inclusion of at least one complete pitch period in each sampling operation. It has been found that the effect of shortening the sampling period does not appear to be marked as long as, for male speakers, the period is significantly longer than 10mS. It will be realised that, in practice, the sampling period minimum length is determined by the time required to perform an evaluation operation which, in the present example, governed as it is by the 8uS period of the P-pulses, is not less than 12.3mS.

We claim:

1. Sound analysing apparatus for the evaluation of speech including means for extracting from an applied speech signal a required formant waveform; means for identifying frequency components of the required formant in the waveform; a first store having a plurality of addressable storage locations each associated respectively with a different predetermined range of frequencies; means for adding during each of a succession of predetermined histogram sampling periods of value of unity for each frequency component identified into that one of the storage locations corresponding to the range in which lies the frequency of the identified component and means for producing over a histogram evaluation period comprising a plurality of sampling periods a histogram representation including means for scanning the storage locations in order, to produce for each successive sampling period a progressive total of the values added into the storage locations during a preceding predetermined number of sampling periods; means for deriving an indication that a predetermined fraction of the total has been at least equalled and means for registering an address representing the frequency range included in location currently being scanned at the time when the indication occurs.

2. Apparatus as claimed in claim 1 in which the means for identifying frequency components includes means for detecting peaks in said formant waveform and for producing peak representing signals; and means for evaluating time intervals elapsing between successive peak representing signals.

3. Apparatus as claimed in claim 2 in which the peak detecting means includes full-wave rectifying means for rectifying the speech signal.

4. Apparatus as claimed in claim 3 in which the frequency component identifying means includes means for generating a train of pulses spaced at constant time intervals; a second store holding in addressable storage locations a sequence of values representing limits of the frequency ranges in order of decreasing frequency, the values being expressed in terms of said time intervals; control means responsive to a first peak representing signal from the peak detecting means to select from the second store the first value of the sequence; means for accumulating pulses from the train to form a total; and means for comparing the accumulated total with the value selected from the second store, the control means also being responsive to the comparing means to select from the second store a new value in the sequence whenever the accumulated total equals the value currently selected from the second store and responsive to the occurrence of a second peak representing signal to register the address of that second store location containing the value currently selected, to signify the frequency range of a waveform component.

5. Apparatus as claimed in claim 4, in which the control means is responsive to a predetermined accumulated total occurring before the second peak representing signal to inhibit the registration of the second store address.

6. Apparatus as claimed in claim 1 wherein the first store has a plurality of segments each containing said plurality of locations associated respectively with said range of frequencies and having control means including means for selecting the segments in cyclic rotation during this histogram evaluation period, each segment being selected to enable its locations to accept the addition of unity values during a whole sampling period; means for addressing during the sampling period the locations of the unselected segments in two successive scanning cycles, the addressing means in each cycle selecting corresponding locations of the segments taken in turn, all the locations being selected in order of their associated frequency ranges.

7. Apparatus as claimed in claim 6 further including means operable during the scanning cycles to accumulate the values in the locations to produce a progressive total of the values; means operable during the first scanning cycle to register a predetermined fraction of the total of the stored values in the unselected segments; and second comparing means operable during the second scanning cycle to compare the registered fraction with the progressive total as it is accumulated.

8. Apparatus as claimed in claim 1 including means for extracting a formant waveform from each speech signals respectively on each of a plurality of channels, and further including means associated with each channel for registering the occurrence of a peak in that channel; means for repeatedly interrogating the peak registering means for the channels in predetermined order to generate peak-representing signals for those channels in which a peak has occured within a predetermined time interval and for applying the peak representing signals to the frequency component identifying means; and address selection means for controlling the sequential selection of the first store location addresses to select only those locations associated with a single channel during a single histogram evaluation period.

9. Apparatus as claimed in claim 1 having means for extracting more than one formant waveform from the applied speech signal in which the first store has a plurality of separate sections, each section having said plurality of storage locations and being connected to receive values relating respectively to a different formant waveform; in which the first store has location addressing means connected in common to all the sections.

* * * * *